United States Patent [19]

Roberts

[11] 4,075,743

[45] Feb. 28, 1978

[54] COMPRESSION CRIMPING APPARATUS

[75] Inventor: John S. Roberts, Ellicott, Md.

[73] Assignee: Kling-Tecs, Inc., Columbia, Md.

[21] Appl. No.: 696,698

[22] Filed: Jun. 16, 1976

[51] Int. Cl.[2] ..... D02G 1/12

[52] U.S. Cl. ..... 28/263; 28/268; 28/251

[58] Field of Search ..... 28/1.6, 1.7, 263, 268, 28/269; 26/21

[56] References Cited

U.S. PATENT DOCUMENTS

| | | | |
|---|---|---|---|
| 2,933,771 | 4/1960 | Weinstock, Jr. | 28/1.6 |
| 3,096,558 | 7/1963 | Rainard et al. | 28/1.6 |
| 3,111,740 | 11/1963 | Stanley | 28/1.6 |
| 3,248,770 | 5/1966 | Shattuck et al. | 28/1.7 |
| 3,553,802 | 1/1971 | Stanley | 28/1.6 |
| 3,587,145 | 6/1971 | McKinney et al. | 28/1.7 |
| 3,639,955 | 2/1972 | Fleissner | 28/1.6 |
| 3,894,319 | 7/1975 | Trifunovic et al. | 28/1.6 |

FOREIGN PATENT DOCUMENTS

| | | | |
|---|---|---|---|
| 719,039 | 10/1965 | Canada | 28/1.6 |

*Primary Examiner*—Robert R. Mackey
*Attorney, Agent, or Firm*—Nolte and Nolte

[57] ABSTRACT

In apparatus for compression crimping fibrous material, such as yarn, comprising a chamber for receiving the yarn from a pair of feed rollers and in which chamber the yarn is compressed, the chamber having corners intercepted by the periphery of the rollers adjacent the sides; there are provided guiding ramps adjacent the nip of the rollers to keep the yarn away from the corners as the yarn advances from the rollers into the chamber.

3 Claims, 6 Drawing Figures

COMPRESSION CRIMPING APPARATUS

BACKGROUND OF THE INVENTION

This invention relates to apparatus for compression crimping fibrous material such as yarn. More particularly, the compression crimping apparatus to which the present invention relates comprises at least one driven roller having a periphery adapted to engage the fibrous material for advancing the fibrous material and stationary walls defining a chamber for receiving the fibrous material from the roller and in which chamber the fibrous material is compressed, the chamber having a cross-section which has at least one corner and the periphery of the roller intercepting at least one corner of the cross-section of the chamber. In the present invention, means are provided for guiding the fibrous material which may ride along the roller periphery from one side of the roller to the other away from the corner as the fibrous material advances from the roller periphery into the chamber whereby the catching of fibers from the fibrous material at the corner is prevented. Generally, the periphery of the roller also intercepts another corner of the cross-section of the chamber. The apparatus of the invention also comprises means for guiding the fibrous material away from that other corner as the fibrous material advances from the roller periphery into the chamber whereby the catching of fibers from the fibrous material at the other corner is also prevented. Usually, there are two rollers, between which is defined a nip, the fibrous material being advanced by driven counter-rotation of the rollers while the fibrous material is received in the nip. The periphery of the second roller intercepts another two corners of the cross-section of the chamber and in the apparatus according to the invention, one of the means for guiding the fibrous material guides the fibrous material away from two of the corners and the other means for guiding the fibrous material guides the fibrous material away from the other two corners whereby the catching of fibers at all four corners is prevented.

Various apparatuses for compression crimping fibrous material are known which comprise at least one driven roller having a periphery adapted to engage the fibrous material for advancing the fibrous material and stationary walls defining a chamber for receiving the fibrous material from the roller and in which chamber the fibrous material is compressed, the chamber having a cross-section which has at least one corner and the periphery of the roller intercepting at least one corner of the cross-section of the chamber. Frequently, the aforementioned roller is paired with another driven roller so that a nip is defined therebetween, the rollers rotate in opposite directions and the fibrous material is received in the nip whereby it is advanced by the counter-rotation of the rollers. The periphery of each of the rollers intercepts two corners of the cross-section of the chamber. In the present invention, in apparatuses of the aforementioned type, it has been recognized that each of the corners of the cross-section of the chamber which is intercepted by a periphery of a roller is a problem in that fibers from the fibrous material tend to get caught at each such corner. The nature of the problem may be explained as follows. In the chamber into which the fibrous material is fed, the fibrous material is compressed. The compression of the fibrous material results in the fibrous material folding over onto itself and forming a plug. This imparts crimp to the fibrous material.

Catching of fibers of the fibrous material at the aforementioned corners tensions the fibers and prevents them from being crimped to as great an extent as fibers which are formed into the plug without interference. The result of such catching is observed as a discontinuity in the integrity of the plug and what appears to be a void and is actually a zone of lower than average crimp in the crimped yarn. Uniformity of crimp is desired by users of the crimped yarn and, consequently, the aforementioned non-uniformity is undesirable.

It is, therefore, an object of the invention to improve crimping apparatus of the aforementiond type by providing means for preventing the catching of fibers of the fibrous material at each corner at which the periphery of one of the aforementioned rollers intercepts a corner of the cross-section of the chamber which receives the fibrous material from the roller and in which chamber the fibrous material is compressed, whereby a crimped yarn of improved uniformity is obtained.

Other objects and advantages of the present invention will be obvious to one skilled in the art from the following description of the invention.

SUMMARY OF THE INVENTION

According to the present invention, in apparatus for compression crimping fibrous material comprising at least one driven roller having a periphery adapted to engage the fibrous material for advancing the fibrous material and stationary walls defining a chamber for receiving the fibrous material from the roller and in which chamber the fibrous material is compressed, the chamber having a cross-section which has at least one corner, the periphery of the roller intercepting at least one corner of the cross-section of the chamber, the improvement is provided which comprises means for guiding the fibrous material away from the intercepted corner as the fibrous material advances from the roller periphery into the chamber whereby the catching of fibers from the fibrous material at the corner is prevented.

When the periphery of the roller also intercepts a second corner of the cross-section of the chamber, the first and second corners being at opposite ends of an edge of the chamber, the edge being substantially parallel to the axis of the roller, the apparatus according to the invention further comprises means for guiding the fibrous material away from the second corner in addition to the means for guiding the fibrous material away from the first corner as the fibrous material advances from the roller periphery into the chamber whereby the catching of fibers from the fibrous material at both corners is prevented.

In the preferred embodiment, the invention is applied to compression crimping apparatus in which a second driven roller is arranged with the first driven roller as a pair of counter-rotating driven rollers having a nip formed therebetween which is adapted to receive the fibrous material for advancing the fibrous material, the second roller intercepting third and fourth corners of the cross-section of the chamber, the third and fourth corners being at opposite ends of another edge of the chamber substantially parallel to the first edge with the first corner being directly opposite the third corner and the second corner being directly opposite the fourth corner and in the apparatus according to the invention, the means for guiding the fibrous material away from the first corner is also for guiding the fibrous material away from the third corner and the means for guiding the fibrous material away from the second corner is also for guiding the fibrous material away from the fourth corner whereby the catching of fibers from the fibrous material at all four corners is prevented.

The aforementioned corners are formed by the intersection of the stationary walls which define the chamber. The guiding means according to the invention may be in the form of ramps on certain of these walls. Such a ramp would have at least a portion thereof in an inclined plane which intersects the wall and that portion of the ramp would extend away from the wall in the direction in which the fibrous material is advanced whereby the fibrous material would be guided away from the adjacent corners. For example, consider the case of one corner. Two of the stationary walls which define the chamber intersect to form the corner. One of the intersecting walls is in a plane substantially normal to the axis of a roller which intercepts the corner and the aforementiond ramp has at least a portion in a plane which intersects and extends away from that wall in the direction in which the fibrous material is advanced. Now consider the case of a third wall. The third wall is directly opposed to the wall on which the aforementioned ramp is formed and defines a second corner which is intercepted by the roller. On the third wall is formed a ramp like that formed on the first wall and which performs the function of guiding the fibrous material away from the second corner whereby the fibers of the fibrous material are prevented from catching at the second corner. Usually, there will be four intersecting walls defining four corners and a pair of nip rollers, one of the rollers intercepting two of the corners and the other roller intercepting the other two corners. One corner intercepted by one of the rollers is directly opposite one corner intercepted by the other roller and the other two intercepted corners are likewise directly opposite each other. The ramps are on the same two walls as mentioned in connection with the discussion above of three walls defining two corners. Now, however, each of the ramps functions to guide the fibrous material away from two corners, namely, a respective pair of the aforementioned opposed corners.

In a particular, preferred embodiment, the first portion of each of the ramps tapers to a point at the intersection thereof with the wall and each ramp further comprises a second portion, the second portion being flat, substantially parallel to the wall which the first portion of the ramp intersects and having an upstream extremity which is contiguous with the downstream extremity of the first portion, and a third portion, the third portion being in an inclined plane extending toward the wall which the first portion intersects in the direction in which the fibrous material is advanced and having an upstream extremity which is contiguous with the downstream extremity of the second portion.

DESCRIPTION OF A PREFERRED EMBODIMENT

The invention will now be further described by reference to a preferred embodiment, as illustrated in the drawings, in which.

Figure 2:
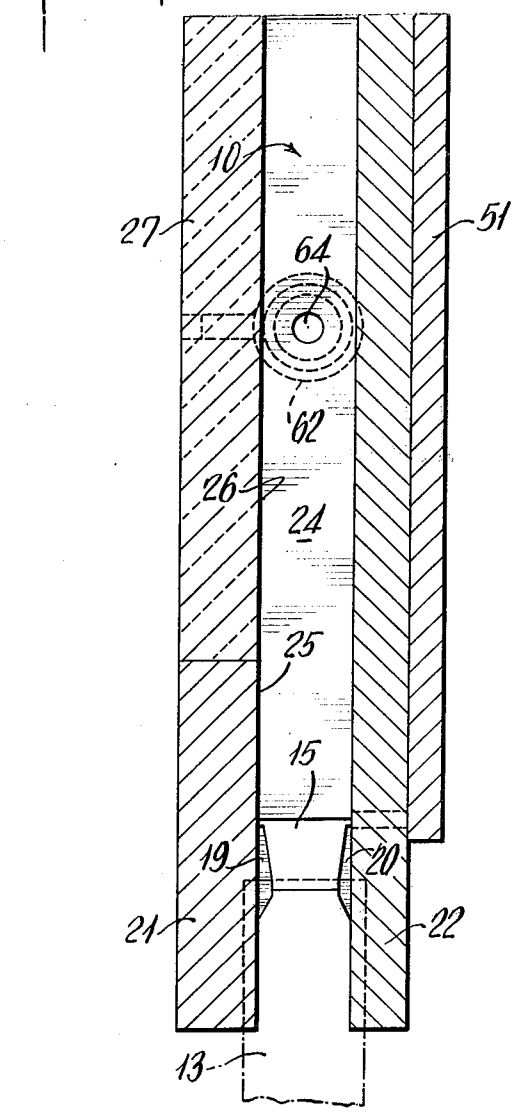
FIG. 2 is a section taken along line 2—2 of FIG. 1.
Figure 1:
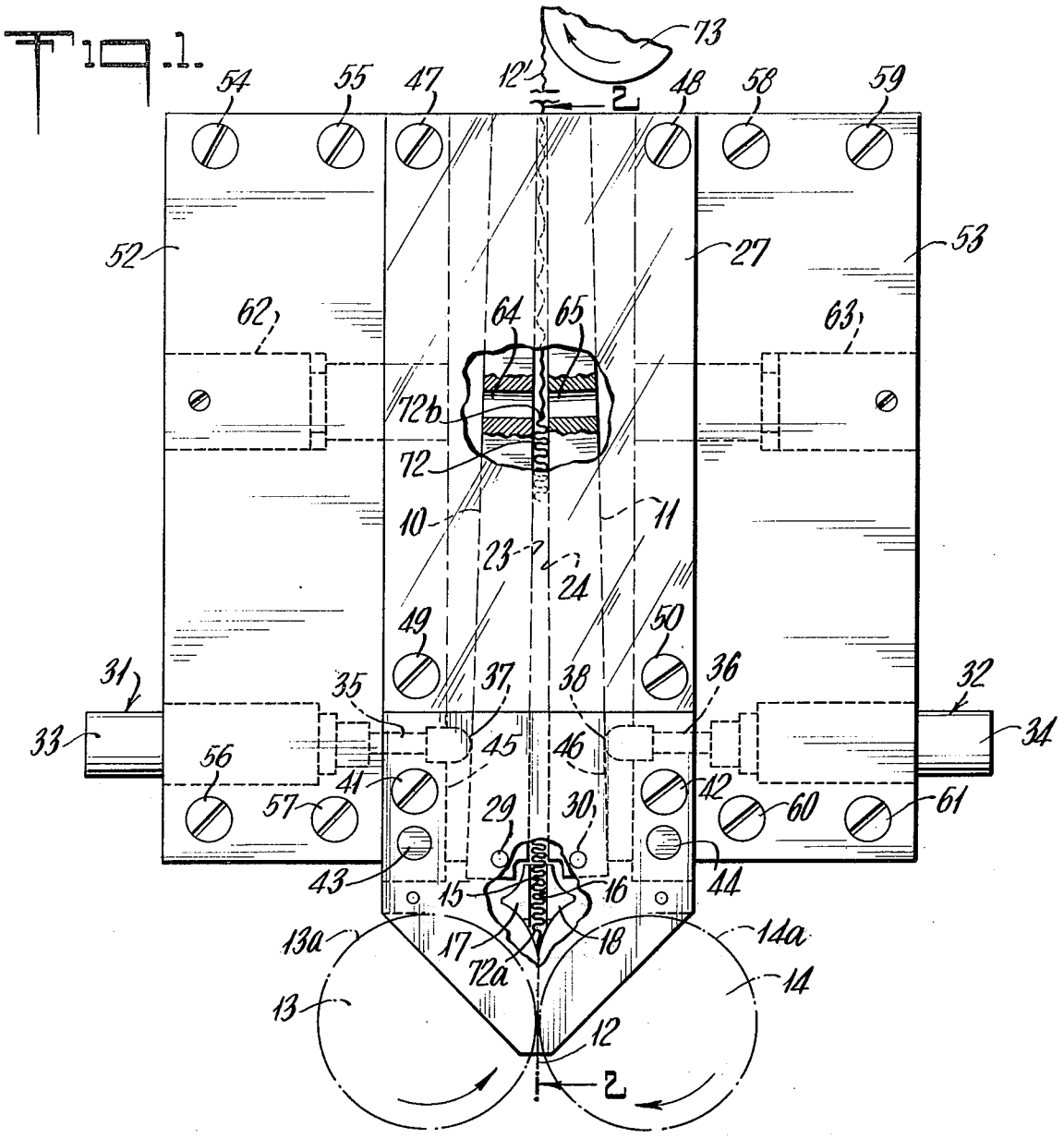
FIG. 1 is a front elevation, partly broken away, of a compression crimping head embodying the improvement of the present invention.

The portion of a crimping apparatus including the crimping zone is commonly referred to as a "crimping head" or a "crimper head." In FIG. 1, a crimping head is illustrated in which members, more particularly pressure shoes, 10 and 11 define lateral walls of the zone. An uncrimped yarn 12 is fed into the crimping head by means of counter-rotating driven nip rollers 13 and 14, the directions of rotation of which are indicated by respective arrows in FIG. 1. The crimping zone has stationary walls defined by mutually opposed faces 15, 16 of respective side rails 17, 18 and by opposed ramps 19 and 20 located on cover 21 and base plate 22, respectively (FIGS. 1 to 4), which walls together define a chamber for receiving the yarn 12 from the rollers 13 and 14. The following portion of the crimping zone has dynamic lateral walls defined by mutually-opposed faces 23, 24 of the shoes 10, 11 together with static walls defined by the upper portion of the inner face 25 of the cover 21 and the inner face 26 of the transparent plastic window 27 which is mounted above and abutting against the cover 21 and on the opposite side by the inner face 28 of the base plate 22 (FIG. 2).

The faces 23 and 24 define dynamic walls of the compression crimping zone because the pressure shoes 10, 11 are mounted on respective pivot shafts 29, 30.

The shoes 10 and 11 are biased toward each other by respective pneumatic cylinder and piston assemblies 31, 32. The assemblies 31, 32 have respective cylinders 33, 34 and respective pistons 35, 36. The pistons 35, 36 are provided with respective end caps 37, 38, which bear against respective shoes 10, 11.

The rails 17, 18 are held by screws 39, 40 between the crimper head base plate 22 and the crimper head cover 21. The base plate 22 extends the rest of the way up to the top of the pressure shoes 10, 11, and on the other side of the pressure shoes 10, 11, a transparent plastic window 27, which permits observation of the plug of yarn which is formed in the crimping zone, extends up to the top of the pressure shoes 10, 11. Screws 41, 42 together with dowels 43, 44 fasten the cover 21 to the base plate 22 with spacer blocks 45 and 46 interposed therebetween. The window 27 is held in place by screws 47 to 50, inclusive. The screws 41, 42 and 47 to 50, inclusive, extend through the base plate 22 into a sub-base plate 51 on which are also mounted blocks 52 and 53 adjacent respective shoes 10 and 11 by means of screws 54 to 61, inclusive.

The foregoing is all, of course, suitably supported on a machine.

The blocks 52 and 53 not only support the pneumatic cylinder and piston assemblies 31 and 32 but also support a light source 62 and a photoelectric cell 63 for receiving light from the light source 62. Respective bores 64 and 65 are formed through the shoes 10 and 11 to permit the passage of light from the light source 62 to the photoelectric cell 63.

Figure 5:
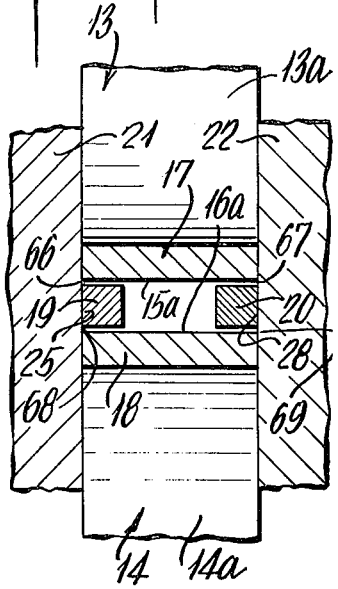
FIG. 5 is a section taken on line 5—5 of FIG. 4.
Figure 6:
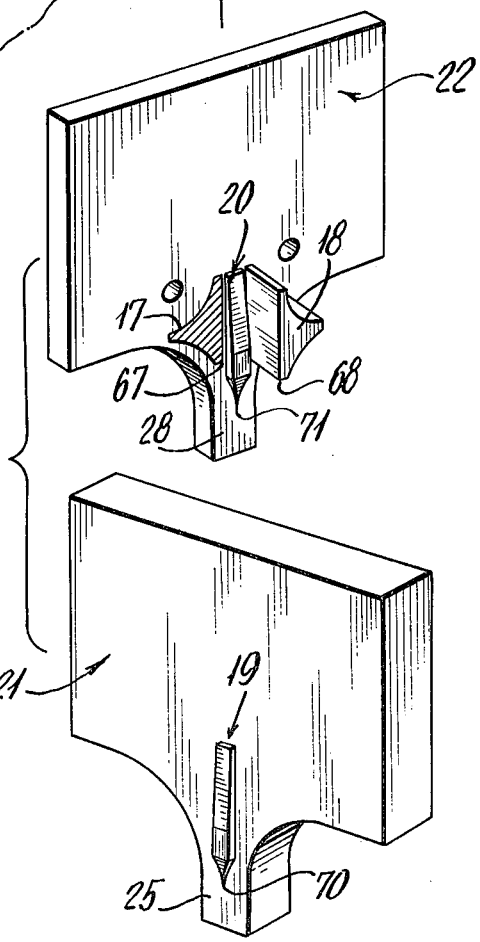
FIG. 6 is an exploded isometric view of the lower portion of the crimper head of FIG. 1.
Figure 4:
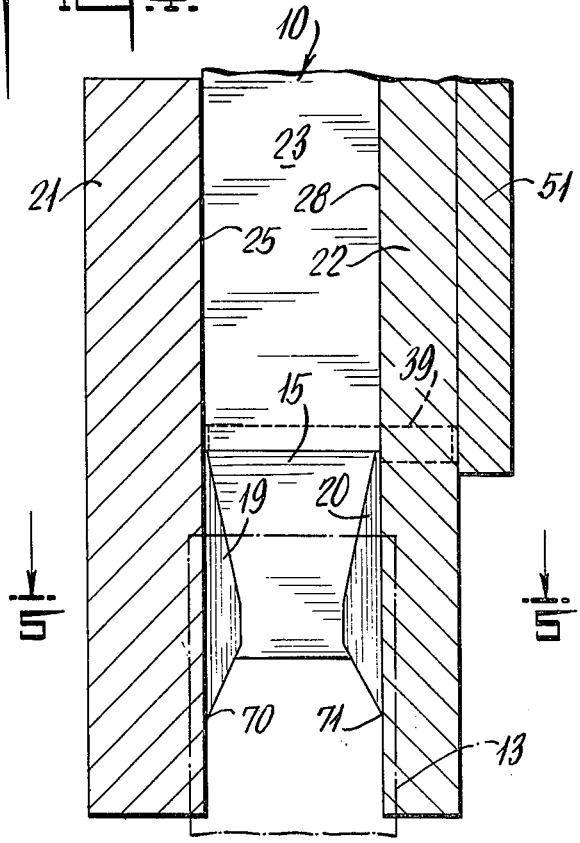
FIG. 4 is a section taken on line 4—4 of FIG. 3.

With reference to FIGS. 5 and 6, particularly the former, it is seen that the periphery **13*a* of the roller 13 intercepts the corners 66 and 67 defined by the intersection of the lower inside edge 15*a* of the face 15 of the rail 17 with the inner face 25 of the cover 21 and the inner face 28 of the base plate 22, respectively, and the periphery 14*a* of the roller 14 intercepts the corners 68 and 69** defined by the intersection of the lower inside edge 16*a* of the face 16 of the rail 18 with the inner face 25 of the cover 21 and the inner face 28 of the base plate 22, respectively. Were it not for the provision of ramps 19 and 20 according to the present invention, which guide the fibrous material clear of the corners 66 to 69, inclusive, fibers would tend to catch at these corners. Turning to FIG. 6, in which the ramps are particularly clearly shown and in which, for the sake of clarity of illustration, one of the rails on the base plate 22 has been broken away, it is seen that the ramps 19 and 20 are of identical configuration. Moreover, as seen from FIG. 4, the ramps 19 and 20 are arranged directly opposite each other. The particular configuration of the ramps as illustrated is due, in substantial part, to machining considerations. From the point of view of the functioning of the ramps, it is seen that the ramp 19 intersects the inner face 25 of the cover 21 at point 70 and then, in the direction in which the fibrous material travels, extends in a plane away from the face 25 and that, similarly, the ramp 20 intersects the inner face 28 of the base plate 22 at point 71 and then, in the direction in which the fibrous material travels, extends in a plane away from the face 28. Then, in order to avoid a very sharp edge, on each ramp a flat is provided and then the ramp recedes back somewhat, toward the face 25 or 28 in the direction in which the fibrous material travels, so that the plug of yarn is not restricted by the ramps 19 and 20.

Figure 3:
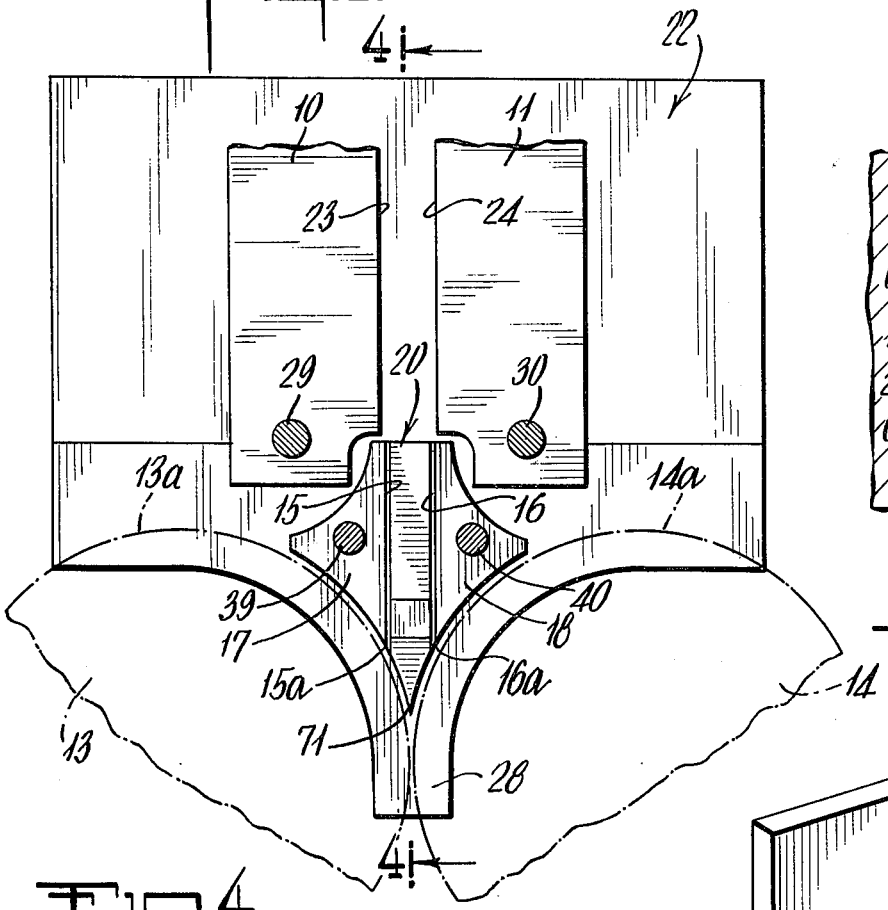
FIG. 3 is a front elevation, partly in section and on a larger scale than FIG. 1, of a portion of the apparatus of FIG. 1.

Finally, it may be noted that the upstream end of each of the ramps 19 and 20 extends slightly inwardly of the respective faces 25 and 28 (FIG. 6). At the same time, as shown in FIG. 3, it can be seen that the distance between the face 15 of the rail 17 and the face 16 of the rail 18 is slightly less than the distance between the inner faces 23 and 24 of the respective shoes 10 and 11 at the bottom portions of the shoes 10 and 11. This is to assure that the static crimping chamber be of smaller cross-section than the dynamic portion of the crimping zone, two lateral walls of which latter portion are defined by the inner faces 23 and 24 of the shoes 10 and 11.

Regarding the operation of the apparatus, an uncrimped yarn 12 is advanced by means of the nip rollers 13 and 14 into the static crimping chanber, two opposed walls of which are defined by the inner faces 15 and 16 of the rails 17 and 18, respectively, and the other two opposed walls of which are now defined by the inner surfaces of the ramps 19 and 20. This is the static part of the crimping zone. From there, the yarn advances into the dynamic portion of the crimping zone, that is, the portion of the two pairs of opposed walls of which is defined by the inner faces 23 and 24 of the shoes 10 and 11. The other walls of the latter portion of the crimping zone are defined by the inner faces of the cover 21, the window 27 and, on the other side, the base plate 22.

A plug of yarn 72, the trailing end 72*a* of which is located in the static crimping chamber, is formed in the crimping zone. The resulting crimped yarn 12' is taken up on a driven take-up package 73. The formation of the plug 72 is due to a combination of the feed speed being greater than the take-up speed and the fact that egress of the yarn is restricted by the shoes 10 and 11, which is all well known. The restriction of the egress of the yarn takes place in normal operation by contact of the opposed faces 23 and 24 of the shoes 10 and 11 with the plug 72 at a portion of the plug 72 including part of the leading end 72*b* thereof as well as immediately subjacent portions of the plug. After the cross-section of the plug 72 is initially defined in the static crimping chamber by the walls of that chamber, the plug 72 essentially holds this cross-section and, hence, is out of contact with the walls of the dynamic portion of the crimping zone until the slight inward inclination imparted to the shoes 10 and 11 and, consequently, the faces 23 and 24 by the action of the cylinder and piston assemblies 31 and 32 causes the faces 23 and 24 to contact the plug 72 at the aforementioned portions and slightly compress the plug 72, thereby restricting egress of the yarn. As is well known by those skilled in the art, it is this restriction which exerts a back pressure against the forwarding of the yarn by the nip rollers 13 and 14, hence causing the yarn to buckle, form a plug and thereby crimp. Naturally, this slight compression of the plug 72 will also cause adjacent portions of the plug 72 on the other sides of the plug 72 to contact the inner face 26 of the window 27 and the inner face 28 of the base plate 22, which, therefore, also contribute to the restriction of the upwards egress of the yarn.

The pressure with which the pistons 35 and 36 act against the shoes 10 and 11 is adjusted so that the normal steady-state operation of the apparatus is as illustrated in FIG. 1. It will be understood that, of course, some oscillation of the pistons and shoes will occur during normal operation as the pistons maintain a substantially constant pressure on the shoes.

Light source 62 and photoelectric cell 63, together with the bores 64 and 65 for passage of the light, are for the purpose of sensing and controlling the position of the leading end 72*b* of the plug 72. To assure that the leading end 72*b* of the plug 72 does not retreat downwards, where no means are provided for sensing the position of the leading end of the plug, the apparatus is operated at relative feed and withdrawal rates such that the leading end 72*b* of the plug 72 tends gradually to move upward. When the plug 72 has moved upward sufficiently so that the light is completely blocked, a relay in conventional circuitry is actuated to speed up the motor driving the take-up package 73 until the photoelectric cell 63 again receives light from the light source 62. It may be desirable to provide conventional means for effecting a slight time delay so that momentary blocking of the light is not sufficient to speed up the take-up whereby the apparatus does not respond to a very transient condition, response being unnecessary.

Apparatus of the type to which the present invention relates is applicable to the crimping of yarns, threads, tows, and the like. These are referred to generically herein as "fibrous material."

While the invention has been described herein particularly with reference to a preferred embodiment, it is to be understood that the scope of the invention, as defined by the appended claims, is intended to include all modifications and variations thereof which would be obvious to one of ordinary skill in the art.

What I claim is:

1. In apparatus for compression crimping fibrous material comprising a pair of feed rollers forming a nip therebetween to engage the fibrous material for advancing the fibrous material and stationary walls defining a chamber for receiving the fibrous material from the rollers and in which chamber the fibrous material is compressed to form a plug of yarn, the trailing end of which becomes situate downstream of the nip of the rollers and against which the yarn entering the chamber impinges, said chamber having corners, the periphery of the rollers along the sides thereof intercepting said corners downstream and outwardly of the nip formed by the rollers, the improvement comprising said stationary walls forming stationary surface means in said chamber immediately adjacent said roller sides for keeping the fibrous material entering said chamber at a location upstream of the trailing end of the plug towards said roller sides away from the intercepted corners, said stationary surface means comprising two opposing surfaces extending within and being formed along the lines of the cusp between and on both sides of said rollers from adjacent the nip of the rollers and downstream to adjacent said corners, and inclining inwardly towards one another from the nip in the direction in which the fibrous material is advanced, whereby the catching of fibers from the fibrous material at the intercepted corners is prevented.

2. Apparatus according to claim 1 in which said opposing surfaces incline away from one another from adjacent said corners to downstream thereof, and in which the cross section of said chamber in the area of said surface means gradually decreases from the nip of the rollers downstream to adjacent said corners and then gradually increases from adjacent said corners to downstream thereof to approximately the same cross sectional dimension as between said opposing surfaces at the nip of the rollers, whereby the plug of yarn formed in said chamber is not restricted in its cross sectional dimension by said surface means.

3. Apparatus according to claim 2 wherein flat parallel surfaces form part of the opposing surfaces between those portions which incline inwardly towards one another and those portions which incline away from one another, whereby sharp edges within said chamber are avoided.

* * * * *